US009378883B2

(12) United States Patent
Tsai et al.

(10) Patent No.: US 9,378,883 B2
(45) Date of Patent: Jun. 28, 2016

(54) TRANSFORMER STRUCTURE

(71) Applicant: Chicony Power Technology Co., Ltd., New Taipei (TW)

(72) Inventors: Hsien-Yi Tsai, New Taipei (TW); Po-Ting Lin, New Taipei (TW); Yu-Ting Yeh, New Taipei (TW); Chi-Hsien Weng, New Taipei (TW)

(73) Assignee: CHICONY POWER TECHNOLOGIES CO., LTD., New Taipei (TW)

( * ) Notice: Subject to any disclaimer, the term of this patent is extended or adjusted under 35 U.S.C. 154(b) by 69 days.

(21) Appl. No.: 14/494,749

(22) Filed: Sep. 24, 2014

(65) Prior Publication Data

US 2016/0086718 A1 Mar. 24, 2016

(51) Int. Cl.

| | |
|---|---|
| ***H01F 27/29*** | (2006.01) |
| ***H01F 27/26*** | (2006.01) |
| ***H01F 27/32*** | (2006.01) |
| ***H01F 27/02*** | (2006.01) |
| ***H01F 5/00*** | (2006.01) |

(52) U.S. Cl.

CPC ..... *H01F 27/266* (2013.01); *H01F 5/00* (2013.01); *H01F 27/02* (2013.01); *H01F 27/29* (2013.01); *H01F 27/292* (2013.01); *H01F 27/324* (2013.01); *H01F 2027/297* (2013.01)

(58) Field of Classification Search

CPC ..... H01F 5/00; H01F 27/00–27/30

USPC ..... 336/65, 83, 192, 196, 200, 232

See application file for complete search history.

(56) References Cited

U.S. PATENT DOCUMENTS

| | | | | |
|---|---|---|---|---|
| 5,559,487 | A * | 9/1996 | Butcher | H01F 27/324 336/178 |
| 5,684,445 | A * | 11/1997 | Kobayashi | H01F 27/2866 336/206 |
| 5,886,610 | A * | 3/1999 | Canova | H01F 27/2847 336/183 |
| 6,114,932 | A * | 9/2000 | Wester | H01F 17/0006 336/192 |
| 6,211,767 | B1 * | 4/2001 | Jitaru | H01F 27/2804 336/200 |
| 6,879,235 | B2 * | 4/2005 | Ichikawa | H01F 38/10 336/200 |
| 8,009,007 | B2 * | 8/2011 | Utsuno | H01F 27/2804 336/200 |
| 8,441,331 | B2 * | 5/2013 | Maple | H01F 27/2847 336/198 |
| 8,536,967 | B2 * | 9/2013 | Kaneko | H01F 27/325 336/196 |

FOREIGN PATENT DOCUMENTS

| | | | |
|---|---|---|---|
| CN | 2570938 | Y | 9/2003 |
| CN | 101170004 | A | 4/2008 |
| EP | 1826785 | A1 | 8/2007 |
| TW | M491930 | U | 12/2014 |

OTHER PUBLICATIONS

Office Action Dated Sep. 11, 2015 of the Corresponding Taiwan Patent Application No. 103125477.

* cited by examiner

*Primary Examiner* — Tuyen Nguyen

(74) *Attorney, Agent, or Firm* — Chun-Ming Shih; HDLS IPR Services

(57) ABSTRACT

A transformer structure includes a first conductive plate, a second conductive plate, a circuit board and a core assembly. The first conductive plate has a first through hole and two first pins, and the first pins are formed by bending two ends of the first conductive plate respectively. The second conductive plate is installed opposite to the first conductive plate and has a second through hole and two second pins, and second pins are formed by bending the two ends of the second conductive plate respectively. The circuit board includes a winding, a positioning portion and a third through hole. The core assembly is electromagnetically coupled to the first conductive plate, the circuit board and the second conductive plate and passed through the first, second and third through holes to provide a high amperage and low-profile transformer structure.

10 Claims, 6 Drawing Sheets

TRANSFORMER STRUCTURE

FIELD OF THE INVENTION

The present invention relates to a transformer, and more particularly to a low-profile transformer structure.

BACKGROUND OF THE INVENTION

In general, an electric appliance comprises a number of magnetic components such as transformers, inductors, etc. However, most of the conventional transformers comprise a bobbin or a coil assembly and a bobbin winding, so that the wire winding window area is decreased, and the utilization is dropped. Obviously, the conventional transformers fail to meet the requirements for the development trend of a compact and low-profile electronic device, and it is difficult to install the transformers in the electric appliances.

To cope with the development trend of the low-profile electric appliances, it is necessary to reduce the height and simplify the structure of the transformers in order to reduce the total volume of the electric appliances. However, the bobbin of the transformer usually comes with a coupled of specifications only, and it is uneasy to change the size of the bobbin, and thus the flexibility of the application of the transformer is low. In addition, the winding of the transformer is usually a single-strand or multi-strand enameled wire, and the shape of the wire is usually circular, so that the way of winding is restricted, and the amperage is low. Therefore, such transformers are inapplicable for low-profile products.

In view of the foregoing problems of the conventional transformer structure with low flexibility for changes and low amperage, the inventor of the present invention based on years of experience in the related industry to conduct extensive researches and experiments and provide a feasible solution in accordance with the present invention to overcome the problems of the prior art.

SUMMARY OF THE INVENTION

Therefore, it is a primary objective of the present invention to provide a high-amperage and low-profile transformer structure.

To achieve the aforementioned objective, the present invention provides a transformer structure, comprising: a first conductive plate, a second conductive plate, a circuit board, and a core assembly. The first conductive plate has a first through hole. The second conductive plate and the first conductive plate are installed opposite to each other, and the second conductive plate has a second through hole. The circuit board is installed and aligned precisely with the first conductive plate and the second conductive plate. The circuit board includes at least one winding, a positioning portion and a third through hole. The positioning portion abuts the first conductive plate to position the first conductive plate on the circuit board. The core assembly is electromagnetically coupled to the first conductive plate, the circuit board and the second conductive plate. The core assembly includes a first through hole, a second through hole and a third through hole and covers the first conductive plate, the circuit board and the second conductive plate.

The present invention has the following advantages and effects: The multilayer circuit board is used to replace the structures of the bobbin and winding, and the flat copper coil is used to reduce the height to provide the low-profile structure, while improving the utilization of the product. In the present invention, the output voltage terminal, the pin of the first conductive plate contained in the groove of the circuit board are overlapped with the pin of the second conductive plate to reduce the total area of the transformer, so as to facilitate the transformer packaging and assembling operations that follow.

DESCRIPTION OF THE PREFERRED EMBODIMENTS

Figure 1:
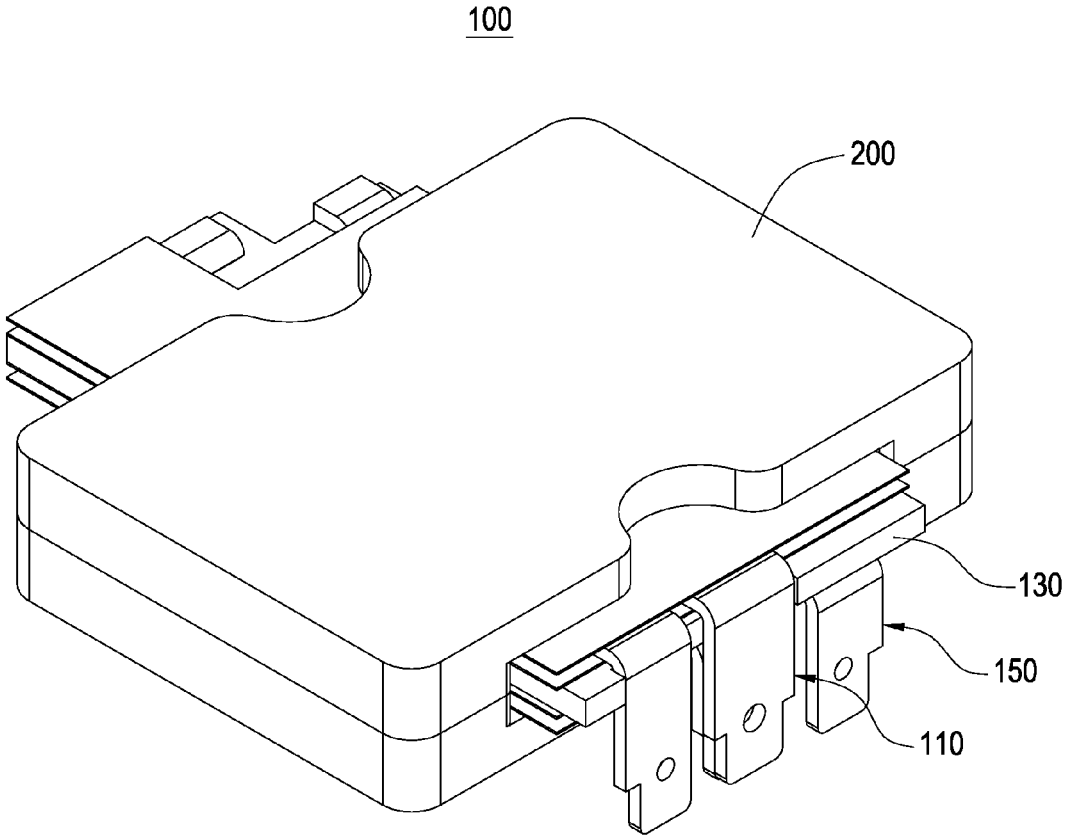
FIG. 1 is a perspective view of a transformer structure of the present invention.

The technical contents of the present invention will become apparent with the detailed description of a preferred embodiment accompanied with the illustration of related drawings as follows. It is noteworthy that same numerals are used for representing same respective elements in the drawings.

With reference to FIGS. 1 to 4 for a transformer structure of the present invention, the transformer structure 100 comprises a first conductive plate 110, a second conductive plate 150, a circuit board 130 and a core assembly 200. The first conductive plate 110 and second conductive plate 150 include but not limited to flat copper coils (which are copper sheets). Since the flat copper coil has a relatively larger wire winding window area Aw, the area of the copper coil may be changed as needed without changing the core area Ae, so that the transformer may have a greater current or output power AP. (Aw·Ae=AP, where Aw is the copper window area, Ae is the core area, and AP is the output power).

The first conductive plate 110 further includes a first conductive plate body 112, a first through hole 114, a first notch 116, two first ends 118, 120 and two first pins 122, 124. In an embodiment, the first conductive plate 110 is in a circular shape. In other embodiments, the first conductive plate 110 may be in a rectangular shape, a polygonal shape, or any other appropriate shape. The first through hole 114 is formed at the central position of the first conductive body 112. The two first ends 118, 120 are parallel to the first conductive plate body 112 and are separated from each other by the first notch 116.

Figure 2:
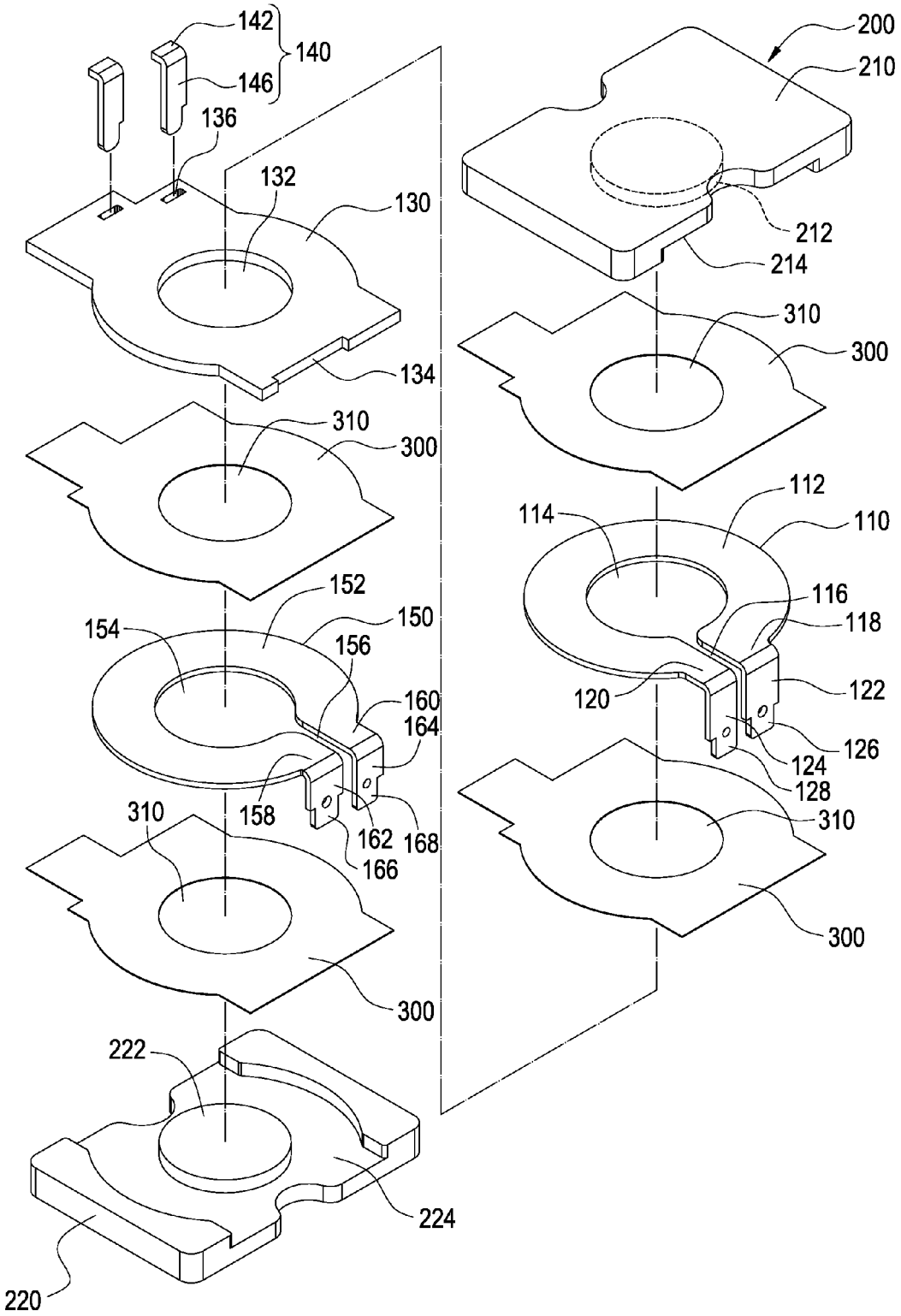
FIG. 2 is an exploded view of FIG. 1.

Each first pin 122, 124 is integrally formed with the first conductive plate body 112, and the first notch 116 is also formed between the two first pins 122, 124. The first pins 122, 124 are formed by bending two ends 118, 120 of the first conductive plate 110 respectively. In other words, the first pin 122 is formed by bending the first end 118 till it is perpendicular to the first conductive plate body 112, wherein the first convex end 126 is disposed at an end of the first pin 122. The first pin 124 is formed by bending the first end 120 till it is perpendicular to the first conductive plate body 112. The first cutaway end 128 is disposed at an end of the first pin 124. In FIG. 2, the first pins 122, 124 are arranged into a straight line. In other words, the first convex end 126 and the first cutaway end 128 are arranged into a straight line.

The second conductive plate 150 is installed opposite to the first conductive plate 110, and the details will be described later. The second conductive plate 150 further includes a second conductive plate body 152, a second through hole 154, a second notch 156, two second ends 158, 160 and two second pins 162, 164. In a preferred embodiment, the second conductive plate 150 is in a circular shape. In other embodiments, the second conductive plate 150 may be in a rectangular shape, a polygonal shape, or any other appropriate shape. The second through hole 154 is formed at the central position of the second conductive body 152. The two second ends 158, 160 are parallel to the second conductive plate body 152 and separated by the second notch 156.

The second pins 162, 164 are integrally formed with the second conductive plate body 152, and the second notch 156 is also formed between the two second pins 162, 164. The second pins 162, 164 are formed by bending the two ends 158, 160 of the second conductive plate 150 respectively. Further, the second pin 162 is formed by bending the second end 158 till it is perpendicular to the second conductive plate body 152, wherein the second convex end 166 is disposed at an end of the second pin 162. The second pin 164 is formed by bending the second end 160 till it is perpendicular to the second conductive plate body 152. The second cutaway end 168 is disposed at an end of the second pin 164.

Figure 3:
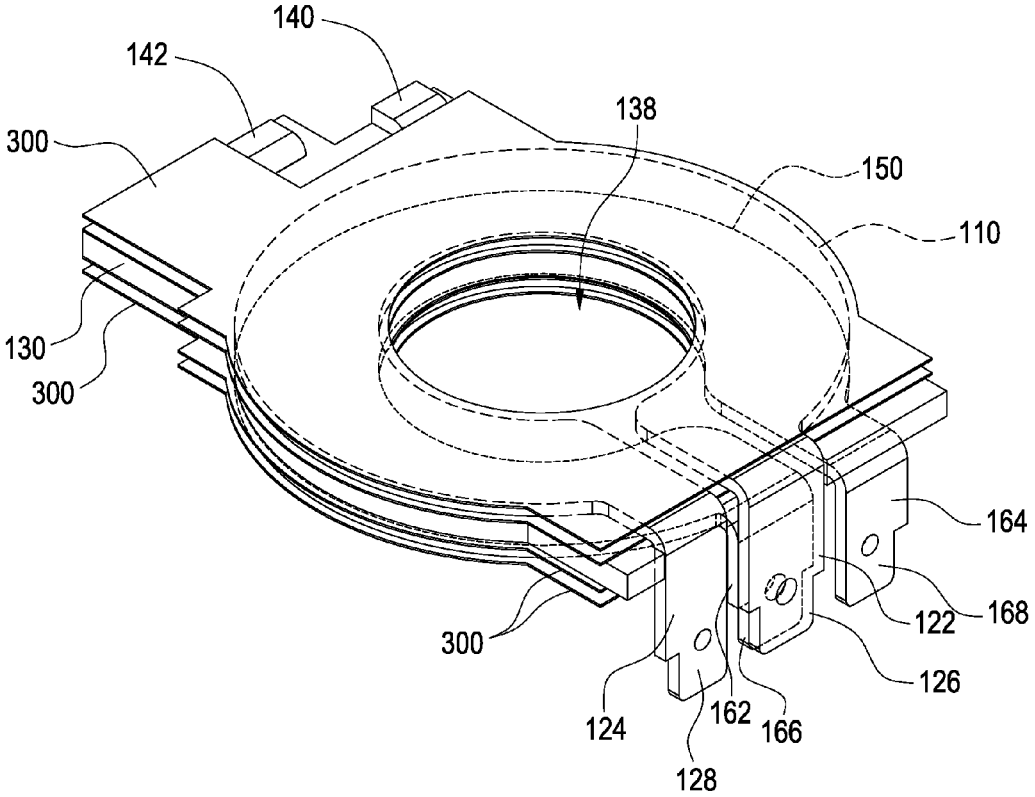
FIG. 3 is a partial perspective view of a transformer structure of the present invention before a core assembly is installed.
Figure 4:
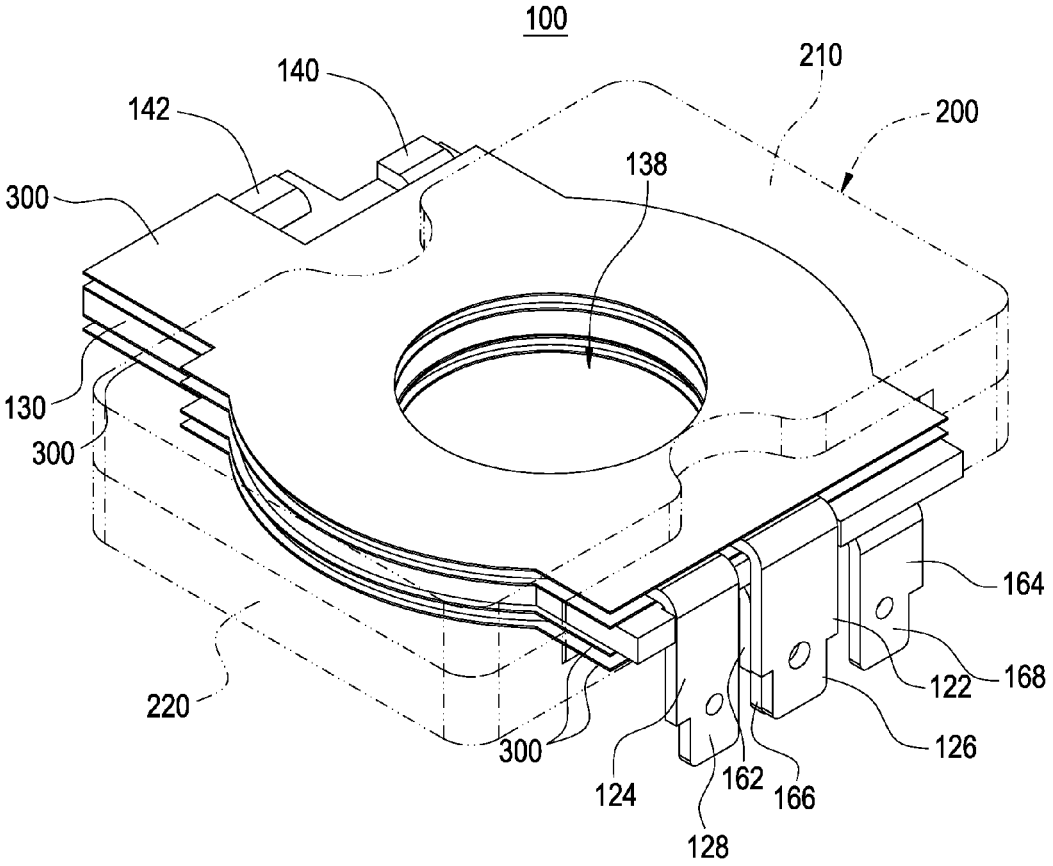
FIG. 4 is a schematic view of installing a core assembly of the present invention, viewing from another angle.

In FIG. 2, the second pins 162, 164 are arranged linearly. In other words, the second convex end 166 and the second cutaway end 168 are arranged into a straight line. In FIG. 3 or 4, the first pins 122, 124 and the second pins 162, 164 are arranged into straight lines respectively. In other words, the first convex end 126 and the first cutaway end 128 are arranged into a straight line, and the second convex end 166 and the second cutaway end 168 are arranged into another straight line. Therefore, the width (or the volume) of the transformer structure 100 can be controlled effectively, and the volume will not become bigger when the first pins 122, 124 or the second pins 162, 164 are arranged alternately with respect to each other.

In this preferred embodiment, the circuit board 130 is installed between the first conductive plate 110 and the second conductive plate 150. In other embodiments, the circuit board 130 may be aligned precisely and installed on a side (which is the top side or the bottom side) of the first conductive plate 110 and the second conductive plate 150. The circuit board 130 is preferably a multilayer circuit board. The coil and/or winding (not shown in the figure) of each circuit board 130 acts as a primary side of the transformer structure 100, and the conductive plates 110, 150 installed at the top and bottom sides of the circuit board 130 act as a secondary side of the transformer structure 100. However, the primary side and the secondary side of the present invention are not limited to the aforementioned arrangement only, but they can be changed according to actual requirements. In this preferred embodiment, the transformer structure 100 achieves a voltage conversion at the secondary side by inputting voltage from the primary side, and going through the electromagnetic effect of the core assembly 200.

The circuit board 130 further includes a third through hole 132. The third through hole 132 is preferably disposed opposite to the first through hole 114 and the second through hole 154, so that the first through hole 114, the second through hole 154, and the third through hole 132 are interconnected to form a penetrating hole 138. In FIGS. 2 and 3, a positioning portion 134 is disposed on a side of the circuit board 130, and two plug holes 136 are formed on the other sides of the circuit board 130. In this preferred embodiment, the positioning portion 134 is preferably a groove for containing each first pin 122, 124. In other embodiments. The positioning portion 134 may be a broken hole (not shown in the figure) for inserting each first pin 122, 124 directly. Therefore, the positioning portion 134 allows the first pin 122 of the first conductive plate 110 and the second pin 162 of the second conductive plate 150 to be overlapped with each other to reduce the total area of the transformer structure 100. In addition, the first pin 122 is used for limiting the position of the second pin 162, so that the additional positioning structure installed on the circuit board is no longer required for positioning the first conductive plate 110 and the second conductive plate 150, and such design facilitate the packaging and assembling operations that follow.

In FIGS. 3 and 4, after the first conductive plate 110 and the second conductive plate 150 are installed on both sides of the circuit board 130 respectively, the first pin 122, 124 of the first conductive plate 110 and the second pin 162, 164 of the second conductive plate 150 are arranged into a straight line. Further, the first convex end 126 and the first cutaway end 128 of the first conductive plate 110 and the second convex end 166 and the second cutaway end 168 of the second conductive plate 150 are arranged into a straight line to facilitate the packaging and assembling operations that follow. Since the first convex end 126 and the second convex end 166 have same polarities, therefore they can be stacked on top of one another, and the first conductive plate 110 is electrically coupled to the second conductive plate 150.

To facilitate the packaging operation of the transformer structure 100, the first convex end 126 and the second convex end 166 are manufactured with the same shape, so that operators are able to distinguish them to perform the operations that follow. In the meantime, the first cutaway end 128 and the second cutaway end 168 are separated. In an embodiment as shown in FIGS. 3 and 4, the three pins of the first conductive plate 110 and the second conductive plate 150 arranged into a row have positive, negative, and positive polarities respectively. However, the invention is not limited to such arrangement only.

Figure 5:
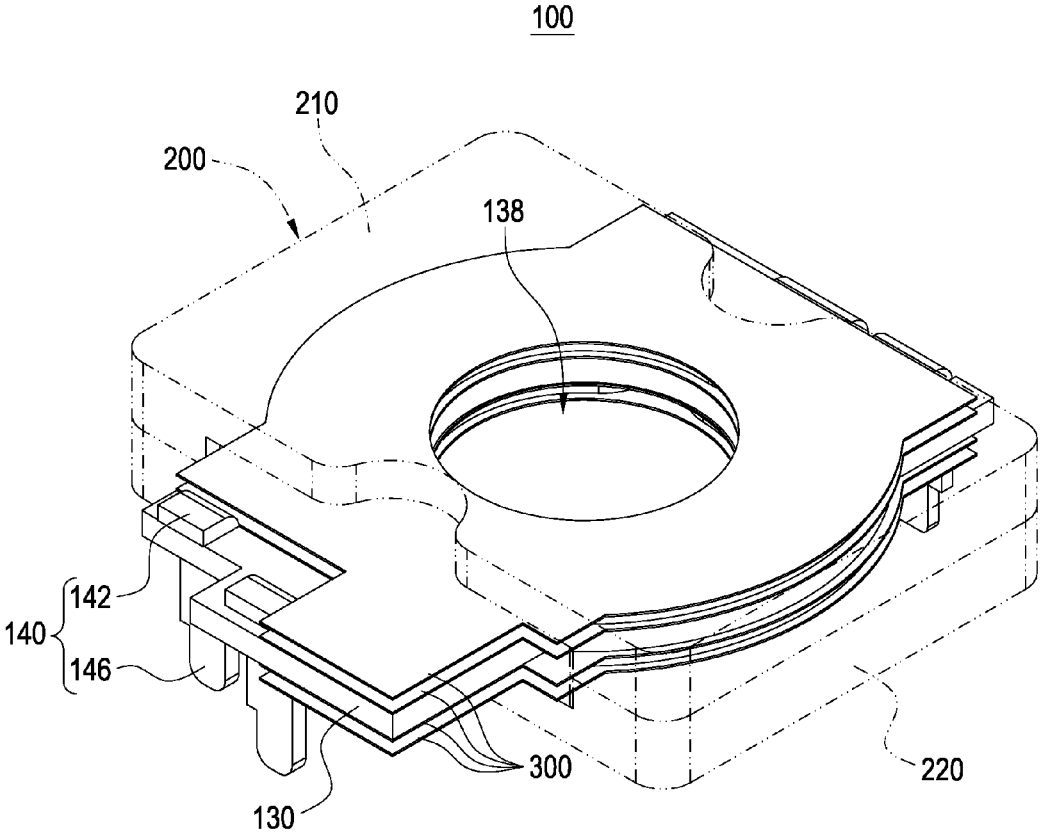
FIG. 5 is a schematic view of installing a core assembly of the present invention, viewing from another angle.
Figure 6:
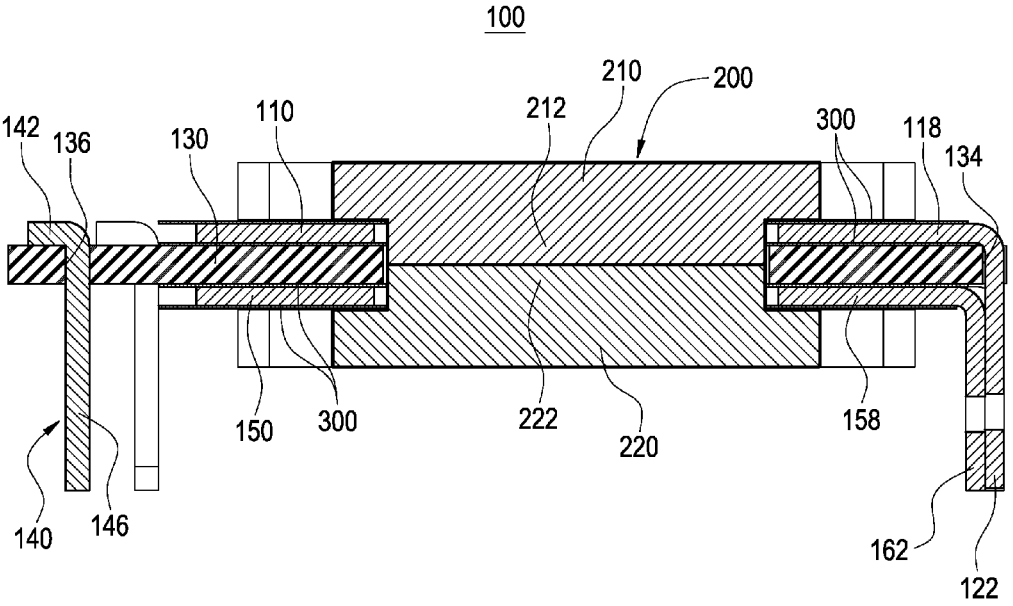
FIG. 6 is a sectional view of a transformer structure of the present invention.

In FIGS. 5 and 6, the circuit board 130 further includes two conductive terminals 140. Each conductive terminal 140 is plugged into the plug hole 136 of the circuit board 130 and has a parallel section 142 and a plug-in section 146. The parallel section 142 is perpendicular to the plug-in section 146, wherein the parallel section 142 abuts an upper end of the circuit board 130. In the figures, each conductive terminal 140 is installed alternately at the plug hole 136 of the circuit board 130 while acting as a voltage input terminal. Each conductive terminal 140 is a plate structure for bearing higher amperage, but its shape is not limited.

In FIGS. 2 and 6, the core assembly 200 is electromagnetically coupled to the first conductive plate 110, the second conductive plate 150 and the circuit board 130, and passed or partially passed through the first through hole 114, the second through hole 154 and the third through hole 132. The core assembly 200 includes but not limited to an EE type iron core and a RM type iron core. The core assembly 200 includes a first magnetic core 210 and a second magnetic core 220. The first magnetic core 210 includes a first core column 212 and a first containing slot 214. The second magnetic core 220 includes a second core column 222 and a second containing slot 224. The first core column 212 and the second core column 222 have a penetrating hole 138, while covering the first conductive plate 110, the circuit board 130 and the second conductive plate 150. The first containing slot 214 and the second containing slot 224 are for containing the first conductive plate 110 and the second conductive plate 150 respectively. The aforementioned components are assembled to form the transformer structure 100 of this preferred embodiment.

It is noteworthy that an insulating membrane 300 such as a Mylar membrane is installed between each conductive plate 110, 150, the circuit board 130 and the core assembly 200 for insulating aforementioned components. Each insulating membrane 300 further includes a fourth through hole 310 configured to be corresponsive to the first through hole 114, the second through hole 154 and the third through hole 132, so that when the first core column 212 and the second core column 222 of the core assembly 200 penetrate through each conductive plate 110, 150 and the circuit board 130, it is necessary to penetrate through the fourth through hole 310 of each insulating membrane 300. Therefore, the transformer structure 100 of this embodiment is assembled.

While the invention has been described by means of specific embodiments, numerous modifications and variations could be made thereto by those skilled in the art without departing from the scope and spirit of the invention set forth in the claims.

What is claimed is:

1. A transformer structure, comprising:

a first conductive plate, having a first through hole;

a second conductive plate, installed opposite to the first conductive plate, and having a second through hole;

a circuit board, sandwiched between the first conductive plate and the second conductive plate, and having a plurality of windings disposed therein, a positioning portion formed on a side thereof and a third through hole, wherein the circuit board further includes two conductive terminals and two plug holes, and each plug hole is formed on another side of the circuit board opposite to the positioning portion, and each conductive terminal is plugged into each respective plug hole of the circuit board for being as a voltage input terminal; and a core assembly, electromagnetically coupled to the first conductive plate, the second conductive plate and the circuit board, passing through the first through hole, the second through hole and the third through hole, and covering the first conductive plate, the second conductive plate and the circuit board, wherein the circuit board is a multilayer circuit board; each winding of each layer of the circuit board acts as a primary side, and the first and second conductive plates installed at top and bottom sides of the circuit board act as a secondary side, so that the transformer structure achieves a voltage conversion at the secondary side by inputting voltage from the primary side and going through the electromagnetic effect of the core assembly.

2. The transformer structure of claim 1, wherein the first conductive plate further includes two first pins formed by bending two ends of the first conductive plate respectively, and the second conductive plate further includes two second pins formed by bending two ends of the second conductive plate respectively.

3. The transformer structure of claim 2, wherein the first pins and the second pins are arranged into a straight line, respectively.

4. The transformer structure of claim 2, wherein the two first pins include a first convex end and a first cutaway end respectively, and the two second pins include a second convex end and a second cutaway end respectively, and the second convex end and the first convex end have the same polarity and are stacked with each other.

5. The transformer structure of claim 2, wherein the positioning portion formed on the side of the circuit board is a groove provided for receiving the two first pins.

6. The transformer structure of claim 4, wherein the first convex end and the first cutaway end are arranged into a straight line, and the second convex end and the second cutaway end are also arranged into a straight line.

7. The transformer structure of claim 1, wherein each conductive terminal includes a parallel section and a plug-in section, and the parallel section and the plug-in section are perpendicular to each other, and the parallel section abuts an upper edge of the circuit board.

8. The transformer structure of claim 1, wherein the conductive terminals are installed alternately on the circuit board.

9. The transformer structure of claim 1, further comprising a plurality of insulating membranes, each being installed between the first conductive plate, the second conductive plate, the circuit board and the core assembly, wherein each insulating membrane further includes a fourth through hole configured to be corresponsive to the first through hole, the second through hole and the third through hole.

10. A transformer structure, comprising:

a first conductive plate, having a first through hole and forming as a first single loop;

a second conductive plate, installed opposite to the first conductive plate, and having a second through hole and forming as a second single loop;

a circuit board, sandwiched between the first conductive plate and the second conductive plate, and having at least one winding disposed therein, a positioning portion formed on a side thereof and a third through hole; and a core assembly, electromagnetically coupled to the first conductive plate, the second conductive plate and the circuit board, passing through the first through hole, the second through hole and the third through hole, and covering the first conductive plate, the second conductive plate and the circuit board, wherein two first pins extend from two facing ends of the first single loop respectively, and two second pins extend from two facing ends of the second single loop respectively; the two first pins abut the positioning portion to position the first conductive plate on the circuit board;

wherein the two facing ends of the first conductive plate are coplanar, and the two facing ends of the second conductive plate are coplanar.

* * * * *